United States Patent [19]

Lewtas et al.

[11] Patent Number: 4,810,262

[45] Date of Patent: Mar. 7, 1989

[54] FUEL COMPOSITIONS

[75] Inventors: Kenneth Lewtas, Wantage, United Kingdom; Stanley J. Brois, Westfield, N.J.

[73] Assignee: Exxon Chemical Patents Inc., Linden, N.J.

[21] Appl. No.: 855,422

[22] Filed: Apr. 23, 1986

[30] Foreign Application Priority Data

Apr. 26, 1985 [GB] United Kingdom ..... 8510719

[51] Int. Cl.[4] ..... C10L 1/22

[52] U.S. Cl. ..... 44/70; 44/62; 44/66; 44/71

[58] Field of Search ..... 44/70, 66, 62, 71

[56] References Cited

U.S. PATENT DOCUMENTS

| | | | |
|---|---|---|---|
| 3,444,082 | 5/1969 | Kautsky | 44/71 |
| 3,846,481 | 11/1974 | Gaydasch | 44/71 |
| 3,982,909 | 9/1976 | Hollyday, Jr. | 44/71 |
| 4,004,894 | 1/1977 | Nohe et al. | 44/70 |
| 4,211,534 | 7/1980 | Feldman | 44/70 |
| 4,375,973 | 3/1983 | Rossi et al. | 44/70 |
| 4,402,708 | 9/1983 | Oswald | 44/70 |
| 4,481,013 | 11/1984 | Tack et al. | 44/70 |
| 4,537,602 | 8/1985 | Rossi et al. | 44/70 |
| 4,569,679 | 2/1986 | Rossi et al. | 44/70 |

FOREIGN PATENT DOCUMENTS

| | | |
|---|---|---|
| 1081330 | 8/1967 | United Kingdom . |
| 1337602 | 11/1973 | United Kingdom . |
| 1442143 | 7/1976 | United Kingdom . |
| 2095698 | 3/1981 | United Kingdom . |
| 2023645 | 10/1982 | United Kingdom . |

*Primary Examiner*—Jacqueline V. Howard
*Assistant Examiner*—Jerry D. Johnson
*Attorney, Agent, or Firm*—M. B. Kapustij

[57] ABSTRACT

A fuel composition comprising a distillate fuel oil and a wax crystal modifier of a derivative of (1) a monocyclic compound having at least 7 ring atoms or of (2) a polycyclic compound, said derivative comprising two substituents attached to adjoining ring atoms in the ring of derivative (1) or in one of the rings of derivative (2). One of said substituents is an amide or a salt of a secondary amine and the other of said substituents is an amide of a primary or secondary amine, a salt of a primary, secondary or tertiary amine, a quaternary ammonium salt or an ester, each substituent containing at least one hydrogen- and carbon-containing group of at least 10 carbon atoms.

23 Claims, 3 Drawing Sheets

PCT PERFORMANCE OF 2,3-DISUBSTITUTED NAPHALENE S

FUEL B

FUEL COMPOSITIONS

Figure 1:
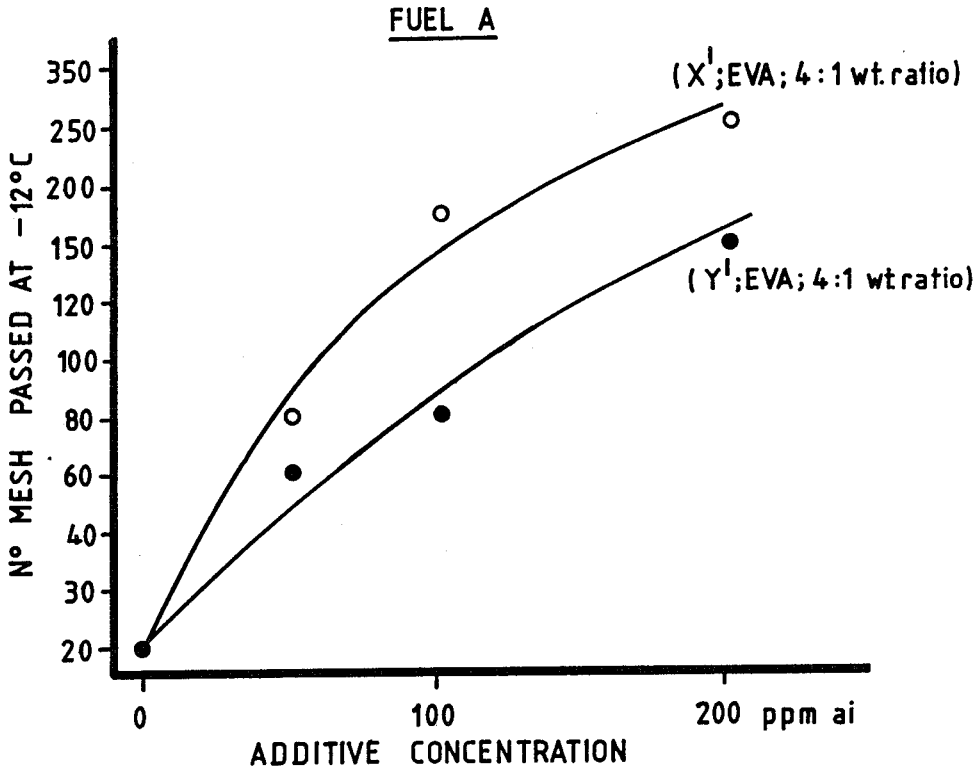

This invention relates to fuel compositions containing wax crystal modifiers.

Long n-alkyl derivatives of difunctional compounds have previously been described as wax crystal modifiers, to wit alkenyl succinic acid (U.S. Pat. No. 3,444,082), maleic acid (U.S. Pat. No. 4,211,534) and phthalic acid (GB 2023645, U.S. Pat. No. 4,375,973 and U.S. Pat. No. 4,402,708). Although it has appeared advantageous in having a ring structure (phthalic acid compared with alkenyl succinic acid and maleic acid) hitherto it has not been recognised that an increased ring size or a polycyclic structure can give improved potency as a wax crystal modifier in middle distillate fuels. We have also discovered that it is essential to have two points of attachment to the nucleus and these points should be to adjoining ring atoms, e.g. the ortho position in the benzene ring. This latter requirement has not been recognised in the middle distillate fuel systems described in GB 2095698A or in U.S. Pat. No. 3,846,481.

According to this invention a fuel oil composition comprises a distillate fuel oil and a minor proportion by weight of a derivative of (1) a monocyclic compound having at least 7 ring atoms or of (2) a polycyclic compound. Such derivatives comprise two substituents attached to adjoining ring atoms in the ring or in a ring. One of these substituents has to be an amide or a salt of a secondary amine and the other of said substituents has to be an amide of a primary or secondary amine, a salt of a primary, secondary or tertiary amine, a quarternary ammonium salt or an ester. It is also essential that for both substituents there is at least one hydrogen- and carbon-containing group of at least 10 carbon atoms attached to the nitrogen atom or forming part of the ester.

This invention also provides the use as a wax crystal modifier of the derivatives (1) and (2) as defined above.

The distillate fuels can be diesel fuel, aviation fuel, kerosene, fuel oil, jet fuel, heating oils etc. Generally, suitable distillate fuels are those boiling in the range of 120° C. to 500° C. (ASTM D1160), preferably those boiling in the range of 150° C. to 400° C., especially those having a relatively high final boiling point (FBP) of above 360° C. The use of such fuels has recently become more extensive and these fuels tend to contain longer chain n-paraffins and will usually have higher cloud points. Usually these fuels are more difficult to treat effectively with conventional flow improvers and low temperature flow problems are more usually encountered with diesel fuels and with heating oils.

The derivatives used as wax crystal modifiers in the fuel oil compositions of this invention are relatively bulky due either to (1) a large ring of at least 7 ring atoms or (2) the presence of two or more ring structures.

The ring atoms in the monocyclic compound having at least 7 ring atoms are preferably carbon atoms, but it could however be a heterocyclic compound which included for example a ring N, S or O atom.

Suitable examples of monocyclic compounds having ring atoms which are all carbon are cyclo-octatetraene, cyclo-octane, cyclo-decapentane, cycloheptane, tropilidene, caprolactam, or similar compounds which are unsaturated or more unsaturated.

The alternative type of compounds, i.e. polycyclic compounds, that is those having two or more ring structures can take various forms. They can be (a) condensed benzene structures, (b) condensed ring structures where none or not all rings are benzene, (c) rings joined "end-on", (d) heterocyclic compounds (e) non-aromatic or partially saturated ring systems or (f) three-dimensional structures.

The condensed benzene structures include for example naphthalene, anthracene, phenanthrene and pyrene

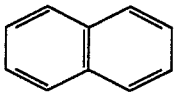
,
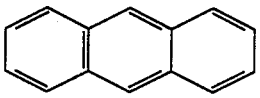
,

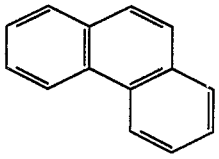
and
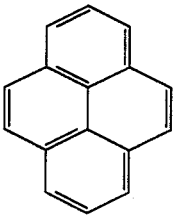

The condensed ring structures where none or not all rings are benzene include for example

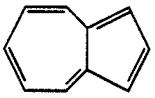
azulene

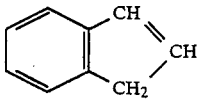

indene

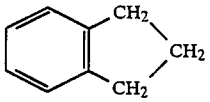

hydrindene

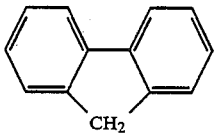

fluorene

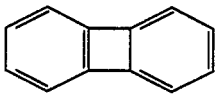
diphenylene

Compounds where rings are joined end-on include for example

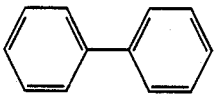

-continued diphenyl

Suitable heterocyclic compounds include for example

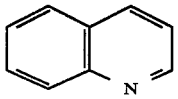

Quinoline

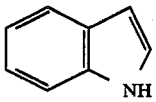

indole

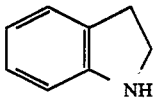

2:3 dihydroindole

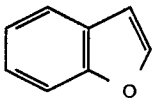

benzofuran

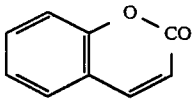

coumarin and

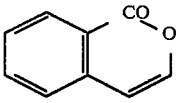

isocoumarin

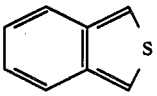

benzothiophen

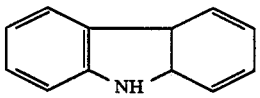

carbazole

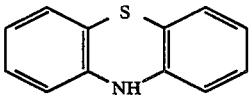

thiodiphenylamine

Suitable non-aromatic or partially saturated ring systems include

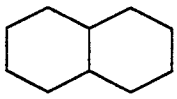

decalin (decahydronaphthalene)

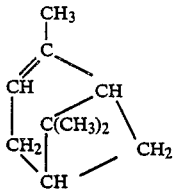

α-pinene

-continued

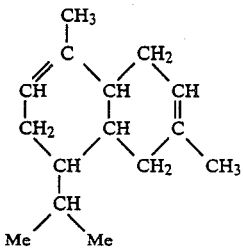

cadinene

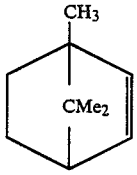

bornylene

Suitable 3-dimensional compounds include for example

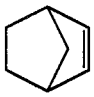

norbornene

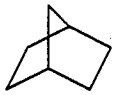

bicycloheptane (norbornane)

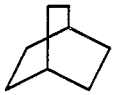

bicyclo octane

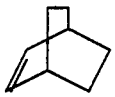

bicyclo octene

The two substituents must be attached to adjoining ring atoms in the ring when there is only one ring or to adjoining ring atoms in one of the rings where the compound is polycyclic. In the latter case this means that if one were to use naphthalene for example these substituents could not be attached to the 1,8- or 4,5-positions, but would have to be attached to the 1,2-, 2,3-, 3,4-, 5,6-, 6,7- or 7,8 positions.

One of these two substituents has to be an amide or a salt of a secondary amine and have a hydrogen- and carbon-containing group containing at least 10 carbon atoms. Such amides or salts may be prepared by reacting the carboxylic acid of the mono- or poly-cyclic compound or anhydride thereof with a secondary amine or alternatively by reacting a secondary amine derivative of the mono- or polycyclic compound with a carboxylic acid or anhydride thereof. Removal of water and heating are necessary to prepare the amides.

These substitutents may be represented by the formulae $-CONR^1R^2$ or

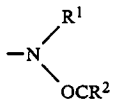

and $-COO^{\ominus}H_2N^{\oplus}R^1R^2$ or $-N^{\oplus}R^1H^{\ominus}OOCR^2$ where $R^1$ and $R^2$ represent hydrogen- and carbon-containing groups, at least one of which containing at least 10 carbon atoms.

The other substituent has to be an amide of a primary or secondary amine, a salt of a primary, secondary or tertiary amine, a quarternary ammonium salt or an ester and has to have a hydrogen- and carbon-containing group containing at least 10 carbon atoms.

These amides and salts may also be prepared by reacting the carboxylic acid of the mono- or polycyclic compound or anhydride thereof with the appropriate amine or alternatively by reacting the appropriate amine derivative of the mono- or polycyclic compound with a carboxylic acid or anhydride thereof; removal of water and heating are also necessary to prepare the amides. The quarternary ammonium salts may be prepared by heating a tertiary amine with hydrocarbyl halide, the cyclic or poly-cyclic compound being part of the tertiary amine or of the hydrocarbyl halide. The ester can be prepared by conventional esterification reactions, using either an alkanol or a carboxylic acid or anhydride of the cyclic or polycyclic compound.

These substituents may be represented by the formulae $-CONHR^3$ or $-COO^{\ominus}H_3N^{\oplus}R^3$ $-CONR^3R^4$ or $-COO^{\ominus}H_2N^{\oplus}R^3R^4$ $-NHOCR^3$ or $-N^{\oplus}H_3{}^{\ominus}OOCR^3$ $-NR^4OCR^3$ or $-N^{\oplus}R^4H_2{}^{\ominus}OOCR^3$ $-COO^{\ominus}HN^{\oplus}R^3R^4R^5$ or $-N^{\oplus}R^4R^5H^{\ominus}OOCR^3$ $-COO^{\ominus}N^{\oplus}R^3R^4R^5R^6$ or $-N^{\oplus}R^4R^5R^6{}^{\ominus}OOCR^3$ $-COOR^3$ or $-OOCR^3$ where $R^3$, $R^4$, $R^5$ and $R^6$ represent hydrogen- and carbon-containing groups, at least one of which on any substituent contains at least 10 carbon atoms.

It should be realised that one of these substituents need to be attached directly to a ring atom, but could if desired be attached via an alkylene group for example. Thus one could use the compound

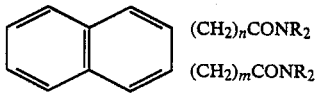

Where n and m are 0, 1 or 2 provided they are not both 0.

The hydrogen- and carbon-containing groups in the substituents are preferably hydrocarbyl groups, although halogenated hydrocarbyl groups could be used, preferably only containing a small proportion of halogen atoms (e.g. chlorine atoms), for example less than 20 weight percent. The hydrocarbyl groups are preferably aliphatic, e.g. alkyl or alkylene. They are preferably straight chain. Unsaturated hydrocarbyl groups e.g. alkenyl, could be used but they are not preferred.

Those groups which have to have at least 10 carbon atoms, preferably have 12 to 22 carbon atoms, for example 14 to 20 carbon atoms. The other hydrogen- and carbon-containing groups can be shorter e.g. less than 6 carbon atoms or may if desired have at least 10 carbon atoms. Suitable alkyl groups include methyl, ethyl, propyl, hexyl, decyl, dodecyl, tetradecyl, eicosyl and docosyl (behenyl). Suitable alkylene groups include hexylene, octylene, dodecylene and hexadecylene.

Since the two substituents have to be attached to adjoining ring atoms of the cyclic or polycyclic compound it is often convenient in preparing the amide, or salt of a secondary amine if an $\alpha$:$\beta$ dicarboxylic acid or anhydride of the cyclic or polycyclic compound is reacted with the secondary amine, whence the substituents will be readily formed on adjoining ring atoms. Quite often in such cases one of the substituents will be an amide and the other will be an amine salt of the secondary amine and the cyclic or polycyclic compound.

The especially preferred derivatives are the amides or amine salts of secondary amines and carboxylic acids of condensed benzene structures, for example naphthalene, especially 2:3 naphthalene dicarboxylic acid.

Although two substituents are necessary for the cyclic derivatives described above it should be realised that these cyclic compounds can contain one or more further substituents attached to ring atoms of the cyclic compounds.

The amount of cyclic compound derivative added to the distillate fuel oil is preferably 0.001 to 0.5 wt.%, for example 0.0001 to 0.002 wt.% (active matter) based on the weight of fuel.

The cyclic compound derivative may conveniently be dissolved in a suitable solvent to form a concentrate of from 20 to 90, e.g. 30 to 80 weight % of the derivative in the solvent. Suitable solvents include kerosene, aromatic naphthas, mineral lubricating oils etc.

EXAMPLE

In this example the di N,N-hydrogenated tallow ($C_{16}$ to $C_{18}$ alkyl) amide of naphthalene 2,3-dicarboxylic acid (X') was compared as a flow improver with the di N,N-hydrogenated tallow ($C_{16}$ to $C_{18}$ alkyl) amide of phthalic acid (Y1). Further comparisons were made using similar naphthalene 2-3 dicarboxylic acid ($X^2$) and phthalic acid ($Y^2$) derivatives except that they were mono amide, mono amine salts.

Figure 2:
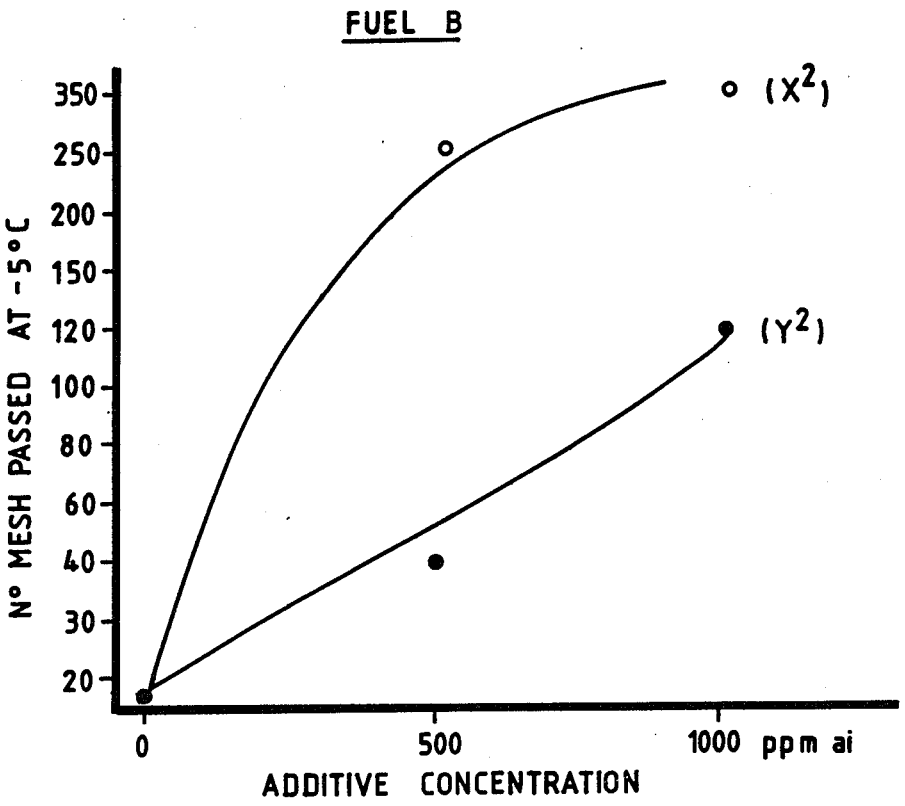
Figure 3:
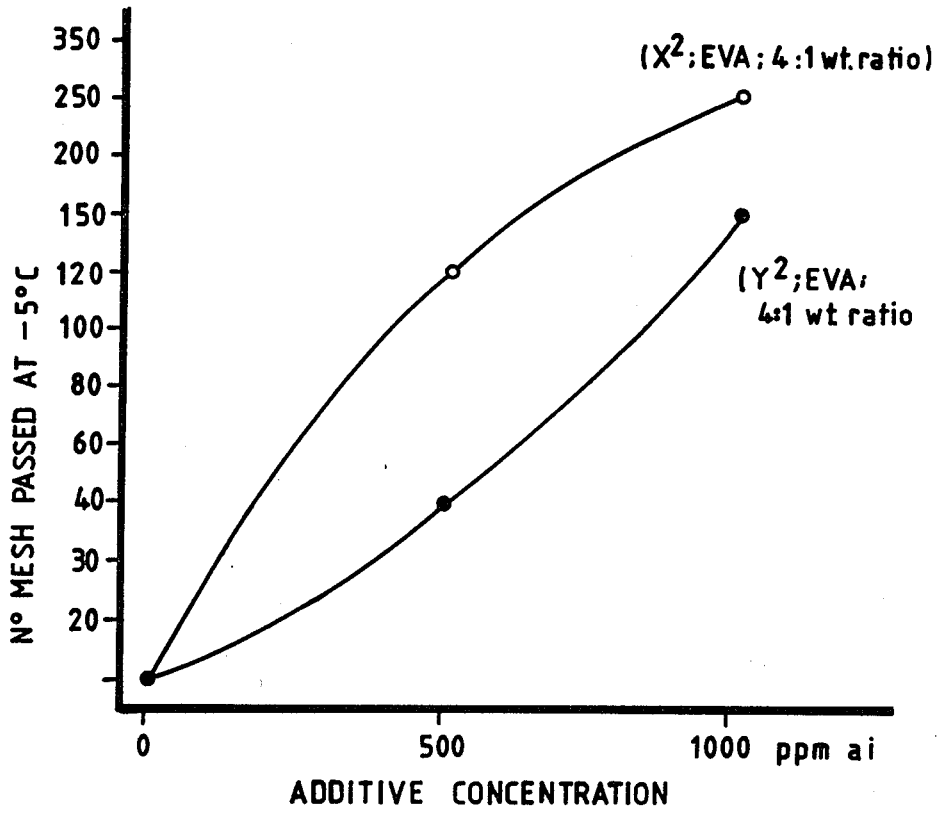

These additives were added to two different fuels at active ingredient concentrations of 50, 100 and 200 ppm (FIG. 1) and 500 and 1000 pmm (parts weight per million) (FIGS. 2 and 3). In some instances (FIG. 1 and FIG. 3) they were blended with an ethylene-vinyl acetate copolymer (EVA) of 3000 average number molecular weight, 17 wt.% vinyl acetate content the weight ratio of additive to EVA of 4:1.

The performance of these additives was determined using the PCT (Programmed Cooling Test) details of which are as follows:

This is a slow cooling test designed to correlate with the pumping of a stored heating oil. The cold flow properties of the described fuels containing the additives were determined by the PCT as follows. 300 ml of fuel are cooled linearly at 1° C./hour to the test temperature and the temperature then held constant. After 2 hours at the test temperature, approximately 20 ml of the surface layer is removed by suction to prevent the test being influenced by the abnormally large wax crystals which tend to form on the oil/air interface during cooling. Wax which has settled in the bottle is dispeersed by gentle stirring, then a CFPPT filter assembly in inserted. The tap is opened to apply a vacuum of 500 mm of mercury, and closed when 200 ml of fuel have passed through the filter into the graduated receiver: a PASS is recorded if the 200 ml are collected within ten seconds through a given mesh size or a FAIL if the flow rate is too slow indicating that the filter has become blocked.

The results are shown in FIGS. 1, 2 and 3 from which it can be seen that there is clear and unexpected advantage using the additives of this invention ($X^1$) and ($X^2$) compared with the prior art additives ($Y^1$) and ($Y^2$).

The two distillate fuels which were used were Fuel A (FIG. 1) and Fuel B (FIGS. 2 and 3), the characteristics of which are as follows.

| FUEL CHARACTERISTICS | A | B |
|---|---|---|
| Cloud Point (CP) °C. | −3.5 | +5 |
| Wax Appearance Point (WAP) °C. | −5.5 | 0 |
| DISTILLATION (ASTM D-86), °C. | | |
| Initial Boiling Point (ibp) | 180 | 228 |
| 20% | 223 | 280 |
| 50% | | 310 |
| 90% | 336 | 351 |
| Final Boiling Point (fbp) | 365 | 374 |

The additives had the formulae:

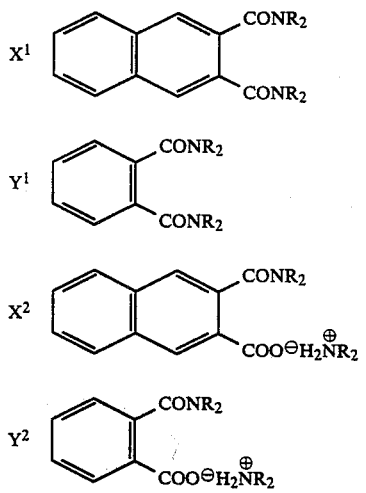

where R is hydrogenated tallow ($C_{16}$ to $C_{18}$ alkyl)

We claim:

1. A fuel composition comprising a distillate fuel oil and at least a wax crystal modifying effective amount of at least one of a derivative of (1) a monocyclic compound having at least 7 ring atoms or of (2) a polycyclic compound, said derivative comprising two substituents attached to adjoining ring atoms in the ring of derivative (1) or in one of the rings of derivative (2), one of said substituents selected from an amide or a salt of a secondary amine and the other of said substituents selected from an amide of a primary or secondary amine, a salt of a primary, secondary, or tertiary amine, a quaternary ammonium salt or an ester, each substituent containing at least one hydrogen and carbon-containing group of at least 10 carbon atoms attached to the nitrogen atom or forming part of the ester.

2. A composition according to claim 1 wherein the distillate fuel oil is one boiling in the range 150° C. to 400° C.

3. A composition according to claim 1 wherein the hydrogen- and carbon-containing groups are straight chain aliphatic.

4. A composition according to claim 1 wherein said hydrogen- and carbon-containing groups contain 14 to 20 carbon atoms.

5. A concentrate comprising an effective solvent containing 20 to 90% by weight of a derivative of (1) a monocyclic compound having at least 7 ring atoms or of (2) a polycyclic compound, said derivative comprising two substituents attached to adjoining ring atoms in the ring of derivative (1) or in one of the rings of derivative (2), one of said substituents being an amide or a salt of a secondary amine and the other of said substituents being an amide of a primary or secondary amine, a salt of a primary, secondary or tertiary amine, a quaternary ammonium salt or an ester, each substituent containing at least one hydrogen- and carbon-containing group of at least 10 carbon atoms attached to the nitrogen atom or forming part of the ester.

6. A concentrate according to claim 5 wherein said derivative is of (2).

7. A concentrate according to claim 5 wherein the hydrogen- and carbon-containing groups are straight chain aliphatic.

8. A concentrate according to claim 5 wherein said hydrogen- and carbon-containing groups contain 14 to 20 carbon atoms.

9. A composition according to claim 1 which contains from 0.001 to 0.5 weight percent of said derivative.

10. A concentrate according to claim 6 wherein said polycyclic compound comprises a condensed benzene structure.

11. A concentrate according to claim 5 wherein said condensed benzene structure is naphthalene.

12. A concentrate according to claim 10 wherein said hydrogen and carbon-containing groups are straight chain aliphatic.

13. A concentrate according to claim 10 wherein said hydrogen and carbon-containing groups contain 14 to 20 carbon atoms.

14. A concentrate according to claim 5 wherein said derivative is of (1).

15. A fuel composition comprising a distillate fuel oil and at least a wax crystal modifying effective amount of at least one derivative of a polycyclic compound comprising two substituent groups attached to adjoining ring atoms in one of the rings, one of said substituent groups selected from amides or salts of a secondary amine and the other of said substituent groups selected from amides of primary or secondary amines, salts of primary, secondary or tertiary amines, quaternary ammonium salts, or esters, each of said substituent groups comprising a hydrogen and carbon-containing group of at least 10 carbon atoms attached to the nitrogen atom or forming part of the ester.

16. The composition of claim 15 wherein said carbon-containing group is a straight chain aliphatic group.

17. The composition of claim 16 wherein said carbon-containing group contains from 14 to 20 carbon atoms.

18. The composition of claim 15 wherein said carbon-containing group contains from 14 to 20 carbon atoms.

19. The composition of claim 15 wherein said polycyclic compound comprises a condensed benzene structure.

20. The composition of claim 19 wherein said condensed benzene structure is naphthalene.

21. The composition of claim 20 wherein said carbon-containing group is a straight chain aliphatic.

22. The composition of claim 20 wherein said carbon-containing group contains from 14 to 20 carbon atoms.

23. The composition of claim 15 which contains from 0.001 to 0.5 weight percent of said derivative of a polycyclic compound.

* * * * *